US008256340B2

(12) United States Patent
Bohs et al.

(10) Patent No.: US 8,256,340 B2
(45) Date of Patent: Sep. 4, 2012

(54) ARTICLE COMPRISING A MISSILE CANISTER COVER

(75) Inventors: Brian E. Bohs, Severn, MD (US); William E. Everitt, Bel Air, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 580 days.

(21) Appl. No.: 11/072,482

(22) Filed: Mar. 4, 2005

(65) Prior Publication Data

US 2006/0207416 A1 Sep. 21, 2006

(51) Int. Cl.
*F41F 3/04* (2006.01)

(52) U.S. Cl. ..... 89/1.816; 89/1.817; 220/265

(58) Field of Classification Search ..... 89/1.816, 89/1.817, 1.81; 220/276, 266, 265; 206/3, 206/317

See application file for complete search history.

(56) References Cited

U.S. PATENT DOCUMENTS

| | | | | |
|---|---|---|---|---|
| 2,576,431 | A * | 11/1951 | White | 220/89.2 |
| 3,670,916 | A * | 6/1972 | Alpert | 220/23.87 |
| 4,207,913 | A * | 6/1980 | Fike, Jr. | 137/68.23 |
| 4,389,938 | A | 6/1983 | Sigrist | |
| 4,471,684 | A | 9/1984 | Johnson et al. | |
| 5,375,503 | A * | 12/1994 | Breugnot et al. | 89/1.817 |
| 5,542,333 | A * | 8/1996 | Hagelberg et al. | 89/1.81 |
| 5,993,921 | A * | 11/1999 | Hunn | 428/34.4 |
| 6,123,005 | A | 9/2000 | Kuchta et al. | |
| 6,363,855 | B1 | 4/2002 | Kim et al. | |
| 2004/0083878 | A1 | 5/2004 | Paul | |

FOREIGN PATENT DOCUMENTS

| | | |
|---|---|---|
| EP | 0022756 | 1/1981 |
| GB | 2124741 A | 2/1984 |

OTHER PUBLICATIONS

Menier, Renan, "PCT Application No. PCT/US2006/006132 International Preliminary Report on Patentability Jun. 26, 2007", Publisher: PCT, Published in: PCT.

Menier, Renan, "PCT Application No. PCT/US2006/006132 International Search Report Jun. 29, 2006", , Publisher: PCT, Published in: PCT.

* cited by examiner

*Primary Examiner* — Gabriel Klein
(74) *Attorney, Agent, or Firm* — Kaplan Breyer Schwarz & Ottesen, LLP

(57) ABSTRACT

The illustrative embodiment of the present invention is a launch system that includes a missile canister cover that, in use, is attached to a missile canister. The cover is capable of being blown off of the canister before there is any contact between the nose of the missile and the cover and is further capable of withstanding a higher ambient pressure than internal canister pressure. These capabilities are achieved based on an attention to material mechanics and the prevailing geometry of the system.

24 Claims, 3 Drawing Sheets

ARTICLE COMPRISING A MISSILE CANISTER COVER

STATEMENT REGARDING FEDERALLY SPONSORED RESEARCH OR DEVELOPMENT

This invention was made with Government support under contract DAAH01-03-C-0035 awarded by the US Army. The Government has certain rights in the invention.

FIELD OF THE INVENTION

The present invention relates to canistered missile, and more particularly to covers for missile canisters.

BACKGROUND OF THE INVENTION

It is well known in the art to launch a missile from a canister. The canisters are typically round or square tubes that contain a missile, missile-launch hardware such as rails and/or sabots, and electronics for initiating launch. In addition to functioning as a launch system, the canisters provide environmental protection for the missile, simplify missile-handling issues, and provide an efficient and long-term solution for missile storage.

In order to provide full environmental protection for the missile and other components within the canister, the canister must be sealed. This is typically done using a cap or cover. The cover is ideally able to protect or isolate the missile from a variety of environmental factors and must provide unimpeded passage of the missile upon launch.

A variety of canister covers are known. Some covers tear or shatter upon contact with the missile during launch. This is acceptable for some but not all types of missiles. In particular, some missiles (e.g., LAM, PAM, etc.) include fragile mechanisms in the nose that could be damaged on impact with the cover. For these types of missiles, the canister cover must blow off without making contact with the missile.

Non-contact covers are typically more elaborate than tear-through designs since they must be actuated to release. This usually equates to increased weight, complexity, and expense.

SUMMARY OF THE INVENTION

The present invention provides a cover for a missile canister that avoids some of the costs and disadvantages of the prior art.

The illustrative embodiment of the present invention is a launch system that includes a canister and a missile, in addition to the canister cover.

A canister cover in accordance with the present invention is capable of:

- Being blown off of the canister before there is any contact between the nose of the missile and the cover; and
- Withstanding a higher ambient pressure than internal canister pressure.

These capabilities are provided without any moving parts; rather, they are realized based on an attention to material mechanics and the prevailing geometry of the system.

More particularly, in accordance with the illustrative embodiment, the capabilities described above are obtained by:

- Segregating the canister into two regions—a main region and a marginal regional—that have different structural properties or characteristics, wherein the marginal region is disposed near the outer edge of the cover and the main region is disposed inward of the marginal regional.
- Attaching the marginal region to the wall of the missile canister.

In the illustrative embodiment, the structural characteristic that differs between the regions of the cover is the thickness of the region. In particular, the marginal region is thinner than the main region.

Since the marginal region is thinner than the main region, and by virtue of the way in which the cover is attached to the canister, the cover breaks directly over the canister wall when exposed to an elevated internal canister pressure. The break occurs in the marginal region, or at the interface between the marginal region and the main region. As a consequence, a single large piece representing the main region of the cover is blown off of the canister.

When the cover is exposed to an external pressure, there is a relatively limited build-up of stress/strain at the interface of the marginal region and the main region. This is because the marginal region is attached to and supported by the forward end of the missile canister. In fact, on exposure to external pressure, the cover might fail at the main region, which is unsupported by the canister, before a failure occurs at the marginal region. On the other hand, to the extent that an internal pressure acts on the cover, high levels of stress/stain will build at the interface of the marginal region and the main region since this region of the cover is not supported against forces that are applied from the inside of the canister. As a consequence, the cover fractures at a relatively lower internal pressure than external pressure.

If an imperfection exists in the cover at some location along the marginal region, a gap or fracture might occur at that location when exposed to elevated internal pressure. Were that to occur, pressure would dissipate such that the cover would not blow off of the canister. To that end, the cover is physically adapted to equalize the response of the marginal region to internal pressure, regardless of location-to-location variations in the marginal region. In the illustrative embodiment, that adaptation is a ridge of material.

DETAILED DESCRIPTION

Figure 1:
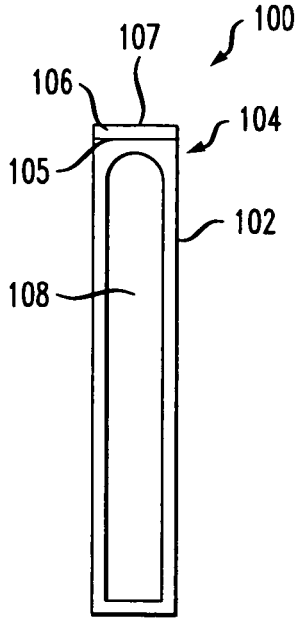
FIG. 1 depicts a missile launcher including a missile canister and a missile-canister cover in accordance with the illustrative embodiment of the present invention.

FIG. 1 depicts missile launcher 100 in accordance with the illustrative embodiment of the present invention. Launcher 100 includes missile canister 102, canister cover 106, and missile 108. Canister cover 106 is coupled to forward end 104 of canister 102. Typically, cover 106 is bolted to canister 102. Missile 108 resides within canister 102. Side 105 of cover 106, which is exposed to the interior of canister 102 when the cover is attached to the canister, is referred to herein as the "inside surface" of cover 106. Side 107 of cover 106, which is exposed to the ambient environment when the cover is attached to missile canister 102, is referred to herein as the "outside surface" of cover 106.

Canister 102 usually contains any one or more of a variety of internal elements or mechanisms, as is well known to those skilled in the art. Since these internals are not germane to an understanding of the present invention, they will not be described in this specification.

Figure 2:
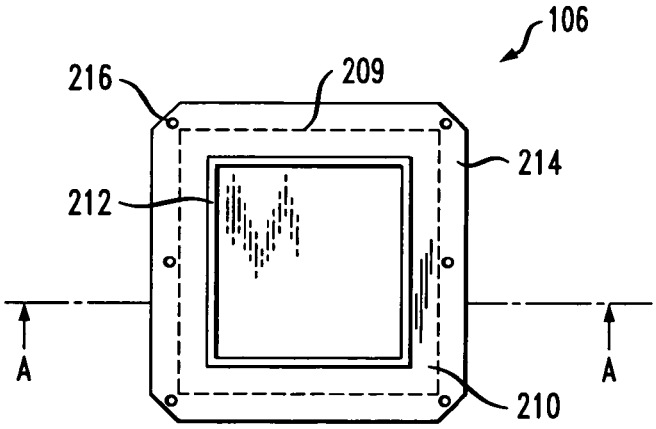
FIG. 2 depicts a bottom view of the missile-canister cover.

FIG. 2 depicts further detail of the inside surface of canister cover 106, in accordance with the illustrative embodiment of present invention. In the illustrative embodiment, canister cover 106 has a polygonal shape; in particular, cover 106 has a substantially square shape. A cover having this shape is typically used in conjunction with a canister that has a square cross section. In some other embodiments, canister cover 106 has a different polygonal shape. In some further embodiments, canister cover 106 has a circular shape, which would be used in conjunction with a canister having a circular cross section.

With continuing reference to FIG. 2, canister cover 106 includes main region 210 and marginal regional 214. Main region 210 includes all the area within dashed line 209 and marginal region 214 encompasses all portions of the cover outside of dashed line 209. It is understood that line 209 is not a feature of canister cover 106; it appears simply for pedagogical purposes. Marginal region 214 is distinguished from main region 210 by its tendency to break or fragment before main region 210. As described in further detail later in this specification, this behavior is due to a physical/structural difference between main region 210 and marginal region 214.

Marginal region 214 includes holes 216 for receiving a bolt, etc., by which canister cover 106 is attached to canister 102. Main region 210 includes a physical adaptation that enables cover 106 to resist pressure equally at all locations along the marginal region (when cover 106 is attached to canister 102). In the illustrative embodiment depicted in FIG. 2, the physical adaptation is ridge 212 that depends from the inside surface of cover 106.

Figure 3:
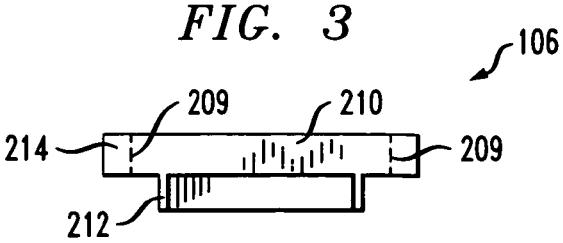
FIG. 3 depicts a side view of the missile-canister cover.

As depicted in FIG. 2, ridge 212 forms a continuous ring within main region 212. As shown in FIG. 3, which is a cross-section through cover 106 at A-A in FIG. 2, ridge 212 extends downward (into the interior of canister 102 when the cover is coupled to canister 102). In some embodiments, ridge 212 is formed of the same material as the rest of main region 210. In some of those embodiments, main region 210 is monolithically formed; that is, ridge 212 is simply formed (e.g., moulded, cut, etc.) from the piece of material that serves as main region 210. In some other of those embodiments, ridge 212 is attached to the surface of main region 210. In some further embodiments, ridge 212 is formed from a different material than the rest of main region 210 and is attached to its surface.

Figure 4:
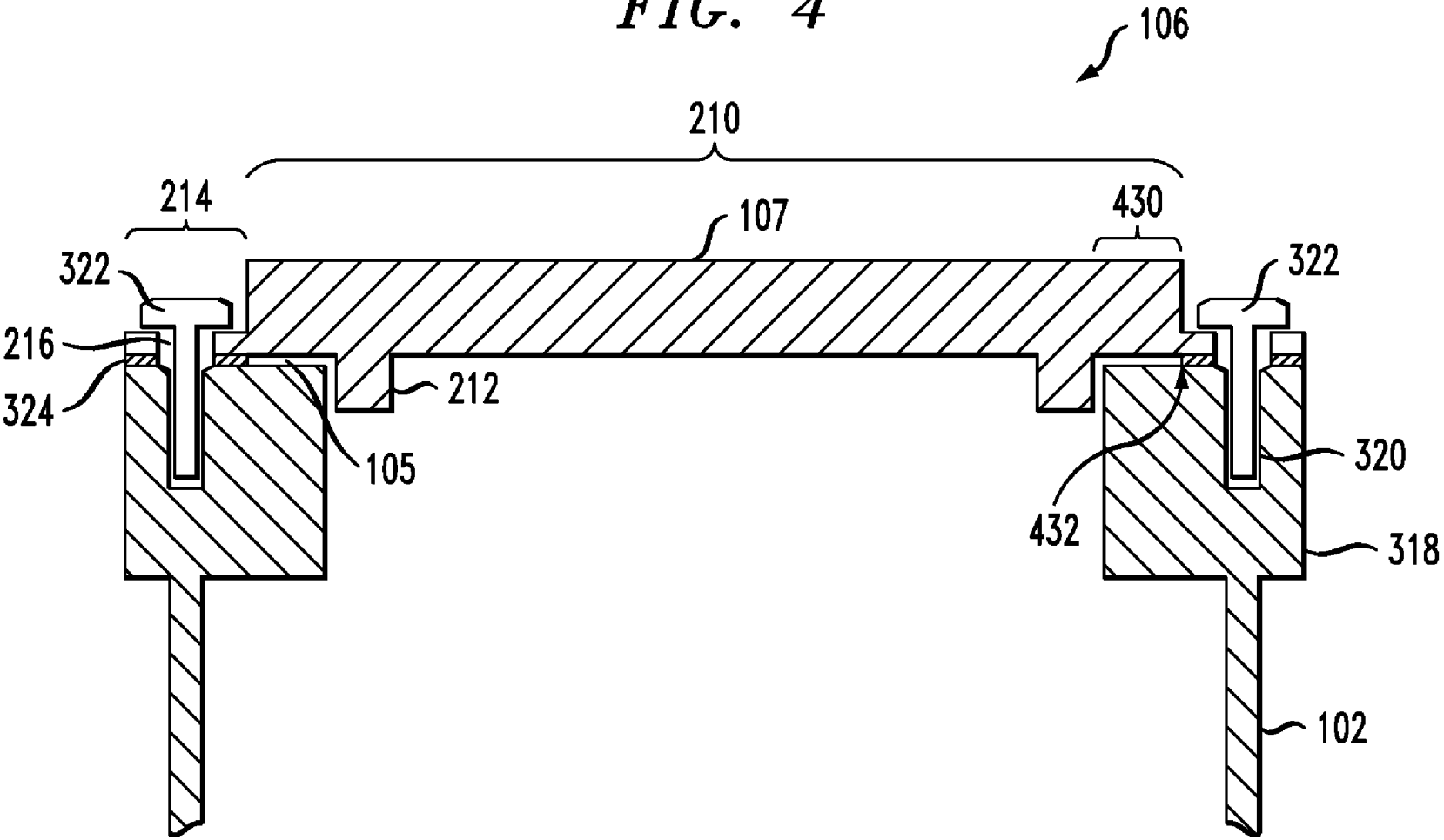
FIG. 4 depicts a cross-sectional view of an embodiment of the missile-canister cover in use, coupled to the missile canister.

FIG. 4 depicts further detail of missile launcher 100. In FIG. 4, missile cover 106 is coupled to missile canister 102.

It was previously disclosed that marginal region 214 is distinguished from main region 210 by a tendency to break or fragment before main region 210. In the embodiment that is depicted in FIG. 4, this is due to the fact that marginal region 214 is thinner than main region 210. In some other embodiments, this behavior results from materials selection, wherein a different material is selected for main region 210 than marginal region 214. That is, the material selected for marginal region 214 has a tendency to break or fragment under pressure at a lower pressure than the material selected for main region 210. In some additional embodiments, the interface between main region 210 and marginal region 214 is pre-stressed or pre-strained, with the result that the interface fractures before either main region 210 or marginal region 214. The stress/strain can result from using dissimilar materials in the two regions, or due differences in crystal structure of the same material, as can develop due to processing conditions, etc.

Cover 106 is coupled to missile canister 102 via bolts 322. In particular, bolt 322 extends through hole 216 in marginal region 214 and engages bolt-receiving hole 320 in forward portion 318 of canister 102. Gasket 324 is disposed between the bottom surface of cover 106 at marginal region 214 and the upper surface of forward portion 318 of canister 102. Gasket 324 provides a pressure-tight seal.

It accordance with the illustrative embodiment, cover 106 is released from canister 102 and blown away from canister 102 during launch but before the nose of missile 108 has a chance to contact the cover. The cover releases due to the pressure generated from exhaust gases on when the missile fires. The design of cover 106 is, therefore, a function of the internal pressure that is developed when the missile ignites and materials composition of cover 106. The internal pressure that develops depends on missile type and the dimensions of the canister. Those skilled in the art will be able to design and build cover 106, after reading the present disclosure, as a function of desired materials of construction, missile type and canister dimensions. Suitable materials for cover 106 include for example, aluminum or glass-filled nylon. More generally suitable materials include any isotropic or quasi-isotropic material with predictable mechanical properties.

As previously described, marginal region 214 is less able to withstand pressure than main region 210. As a consequence, cover 106 fractures at marginal region 214 due to launch pressure.

Launch system 100 must be able to withstand elevated external pressure. In particular, it is important that when cover 106 is exposed to such elevated external pressures, it does not fracture. In fact, it is possible that cover 106 will be exposed to external pressures that are as high as the internal pressure that is developed by the missile plume (which causes cover 106 to blow off of canister 102). As a consequence, cover 106 must be able to withstand a higher level of external pressure (i.e., pressure against its outside surface 107) than internal pressure (i.e., pressure against its inside surface 105). In other words, assume that cover 106 fractures when the internal canister pressure reaches magnitude P1, wherein the elevated pressure results from the release into canister 102, on ignition, of missile exhaust gases. Cover 106 will not fracture, however, when exposed to an external pressure of the same magnitude, P1.

In accordance with the illustrative embodiment, this differential response to pressure is achieved by the way cover 106 is supported. In particular, in the illustrative embodiment, inside surface 105 of cover 106 is supported at marginal region 214, but outside surface 107 is not supported.

Specifically, to the extent an external pressure is applied, marginal region 214, the interface of the marginal region and the main region, and peripheral portion 430 of main region 210 deflect only a minimal distance (i.e., the thickness of gasket 324) until they abut upper surface 432 of forward end 318 of canister 102. They are, therefore, prevented from deflecting to any substantial degree. As a consequence, there is a relatively limited build-up of stress/strain in the interface of main region 210 and marginal region 214. As a result, a break does not occur. To the extent that an internal pressure acts on cover 106, high levels of stress/stain will build at the interface of marginal region 214 and main region 210. This occurs since cover 106 is not supported against forces that are applied against it from the inside of the canister. As a consequence, cover 106 has a diminished ability to resist internal pressure as compared to its ability to resist external pressure.

As previously described, ridge 212 equalizes the response of marginal region 214 to internal canister pressure. In particular, ridge 212 prevents cover 106 from fracturing at a single location along marginal region 214, as might otherwise occur if marginal region 214, at that location, were structurally compromised relative to other locations along the marginal region. If marginal region 214 were to fracture at a single location, then pressure would rapidly dissipate at that fracture and cover 106 would not blow off, as desired.

Figure 6:
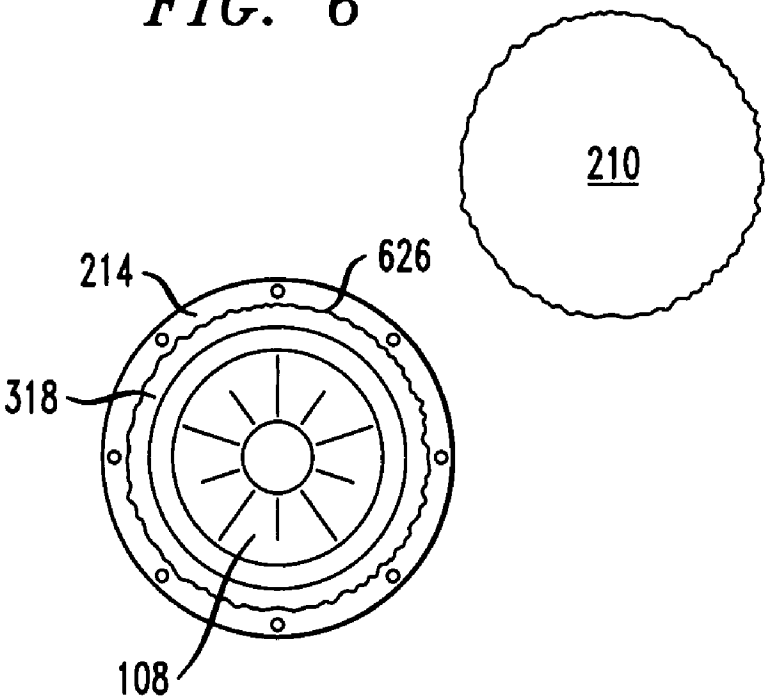
FIG. 6 depicts a top view of the missile-canister cover of FIG. 5 after it has ruptured due to exposure to an internal canister pressure that exceeds the pressure tolerance of the cover.
Figure 5:
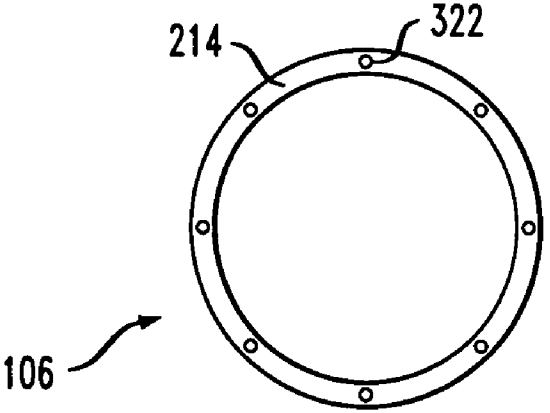
FIG. 5 depicts a top view of a missile-canister cover in accordance with the illustrative embodiment of the present invention, wherein the cover is bolted to a missile canister.

FIGS. 5 and 6 depict a top view of launch system 100 before and during launch.

FIG. 5 depicts launch system 100 in a pre-launch state. Cover 106 is bolted to canister 102 (not depicted in FIG. 5) via bolts 322 in marginal region 214. FIG. 6 depicts launch system 100 after cover 106 has blown off canister 102. As depicted in FIG. 6, cover 106 fractures at 626 near interface of marginal region 214 and main region 210. The main region flies off of canister 102 in a substantially single piece, while marginal region 214 remains attached to upper surface of forward region 318 of canister 102. Missile 108 is visible within canister 102. Egress is now unimpeded such that there will be no contact between the nose of missile 108 and missile cover 106.

It is to be understood that the above-described embodiments are merely illustrative of the present invention and that many variations of the above-described embodiments can be devised by those skilled in the art without departing from the scope of the invention. It is therefore intended that such variations, and others that will occur to those skilled in the art in view of the present disclosure, be included within the scope of the following claims and their equivalents.

We claim:

1. An article for use with a missile canister, the missile canister having a cover-supporting surface, wherein the article comprises a blow-off cover for the missile canister, wherein the blow-off cover comprises:

a centrally-disposed main region having a first thickness, wherein the main region blows off of the missile canister when exposed to sufficient internal pressure;

a peripherally-disposed marginal region having a plurality of bolt holes formed therethrough and a second thickness, wherein the marginal region and a portion of the main region overlie the cover-supporting surface of the missile canister and wherein an underlying surface of the marginal region and an underlying surface of the main region are co-planar; and a continuous ridge in a form of a ring that extends in a canister-inward direction from an inside surface of the main region, wherein the ridge:

(a) extends below the cover-supporting surface and into the missile canister when the blow-off cover is mounted thereto;

(b) is spaced apart from, and radially inward of the cover-supporting surface and the marginal region when the blow-off cover is mounted to the missile canister; and (c) is radially inward of a location at which the blow-off cover fractures on exposure to sufficient internal canister pressure.

2. The article of claim 1 wherein the ridge is dimensioned and arranged so that it enables the cover to resist pressure equally at all locations along the marginal region.

3. The article of claim 1 wherein the ridge is no more than 2 inches radially inward of the cover-supporting surface.

4. The article of claim 1 wherein the inside surface of the main region is flat and planar.

5. The article of claim 1 wherein the main region has a uniform thickness, which thickness is the first thickness.

6. The article of claim 1 further comprising a first physical adaptation that causes the cover to fracture in the marginal region or at an interface between the main region and the marginal region when the cover is exposed to an internal canister pressure having a first magnitude but not when the cover is exposed to an external canister pressure having the first magnitude.

7. The article of claim 6 wherein the first physical adaptation comprises an arrangement of the marginal region and the main region with respect to the cover-supporting surface that results in less stress or strain at the interface of the main region and the marginal region when the cover is exposed to external pressure than when it is exposed to internal pressure.

8. The article of claim 6 wherein the first physical adaptation comprises an arrangement of the marginal region and the main region with respect to the cover-supporting surface wherein, when the cover is coupled to the canister, the cover-supporting surface limits deflection of the marginal region and the portion of the main region in a canister-inward direction sufficiently to prevent the fracture from occurring when the cover is exposed to an external pressure having the first magnitude.

9. The article of claim 7 wherein the first physical adaptation further comprises a difference in a structural property or characteristic between the marginal region and the main region.

10. The article of claim 9 wherein the differing structural property or characteristic is a respective thickness of the main region and the marginal region, and wherein the marginal region is thinner than the main region.

11. The article of claim 1 further comprising the canister.

12. The article of claim 1 further comprising a missile, wherein the missile is disposed within the canister.

13. An article for use with a missile canister having a cover-supporting surface, wherein the article comprises a blow-off cover for the missile canister, wherein the blow-off cover comprises:

a centrally-disposed main region;

a peripherally-disposed marginal region having a plurality of bolt holes formed therethrough, wherein when the blow-off cover is coupled to and seals the missile canister:

(a) the marginal region and a portion of the main region overlie the cover-supporting surface of the missile canister;

(b) an underlying surface of the marginal region is supported and the portion of the main region is spaced from the cover-supporting surface by an air gap; and a continuous ridge in a form of a ring that extends in a canister-inward direction from an inside surface of the main region, wherein the ridge extends below the cover-supporting surface and into the missile canister when the blow-off cover is mounted thereto, and is spaced apart from and radially inward of the cover-supporting surface.

14. The article of claim 13 wherein the ridge is dimensioned and arranged so that it enables the cover to resist internal canister pressure equally at all locations along the marginal region, thereby preventing loss of pressure through a localized fracture along the marginal region.

15. The article of claim 13 wherein the ridge is no more than 2 inches radially inward of the cover-supporting surface and is radially inward of vertical walls defining an orifice that is sealed by the blow-off cover.

16. The article of claim 13 wherein the main region has a uniform thickness.

17. The article of claim 13 wherein the blow-off cover fractures when exposed to a first pressure at the inside surface thereof, and further wherein at least some part of the portion of the main region that overlies the cover-supporting surface will deflect toward and contact the cover-supporting surface before the pressure acting an outside surface of the blow-off cover exceeds the pressure acting on the inside surface of the blow-off cover by an amount equal to the first pressure, thereby limiting deflection of the marginal region and the portion of the main region in the canister-inward direction to prevent fracture of the blow-off cover.

18. An article comprising a blow-off cover for a missile canister, wherein the blow-off cover comprises:

a centrally-disposed main region have a uniform thickness;

a peripherally-disposed marginal region having a plurality of bolt holes formed therethrough and a thickness that is less than the uniform thickness of the main region; and a continuous ridge in a form of a ring or polygon that extends in a canister-inward direction from an inside surface of the main region when the blow-off cover is attached to the canister, wherein the ridge is dimensioned and arranged so that it enables the cover to resist internal canister pressure equally at all locations along the marginal region, thereby preventing loss of pressure through a localized fracture along the marginal region.

19. The article of claim 18 wherein the ridge comprises two vertical surfaces that extend from the inside surface of the main region.

20. The article of claim 18 wherein in the absence of fracture of the marginal region, the ridge is spaced-apart from the canister and is radially inward of vertical walls defining an orifice that is sealed by the blow-off cover.

21. The article of claim 18 further comprising a first physical adaptation that causes the cover to fracture in the marginal region or at an interface between the main region and the marginal region when the cover is exposed to an internal canister pressure having a first magnitude but not when the cover is exposed to an external canister pressure having the first magnitude.

22. The article of claim 18 wherein when the cover is coupled to the canister, and in the absence of pressure differential acting on the cover, a portion of the main region is spaced apart from a cover-supporting surface that the portion of the main region overlies.

23. The article of claim 21 wherein, when the cover is coupled to the canister, a portion of the main region contacts an underlying support surface when exposed to an external pressure having a second magnitude, which second magnitude is greater than a minimum value and less than a maximum value, wherein the minimum value is equal to the internal canister pressure and wherein the maximum value is equal to a pressure that exceeds internal canister by the first magnitude.

24. An article for use with a missile canister having a cover-supporting surface, wherein the article comprises a blow-off cover for the missile canister, wherein the blow-off cover comprises:

a centrally-disposed main region having a first thickness, wherein the main region blows off of the missile canister when exposed to sufficient internal pressure;

a peripherally-disposed margin region having a plurality of bolt holes formed therethrough and a second thickness less than the first thickness, wherein the main region and the marginal region are arranged to fracture in the marginal region or at an interface between the main region and the marginal region when the cover is exposed to an internal canister pressure having a first magnitude but not when the cover is exposed to an external canister pressure having the first magnitude; and a continuous ridge in a form of a ring or polygon that extends in a canister-inward direction from an inside surface of the main region, wherein the ridge extends below the cover-supporting surface and into the missile canister when the blow-off cover is mounted thereto, and is spaced apart from and radially inward of the cover-supporting surface.

* * * * *